US006164601A

United States Patent [19]

Scheer et al.

[11] Patent Number: 6,164,601

[45] Date of Patent: Dec. 26, 2000

[54] RAILROAD SWITCH MACHINE

[76] Inventors: Jerry L. Scheer, 508 E. 32nd St., Fremont, Nebr. 68025; David W. McCord, 13616 "W" St., Omaha, Nebr. 68137

[21] Appl. No.: 09/106,590

[22] Filed: Jun. 29, 1998

[51] Int. Cl.[7] ..... B61L 11/06

[52] U.S. Cl. ..... 246/258; 246/393

[58] Field of Search ..... 246/221, 257, 246/258, 262, 364, 393

[56] References Cited

U.S. PATENT DOCUMENTS

| | | | |
|---|---|---|---|
| 2,977,893 | 4/1961 | Rosenbaum | 104/130 |
| 2,996,017 | 8/1961 | Gorjanc et al. | 104/102 |
| 3,223,048 | 12/1965 | Gorjanc | 104/102 |
| 3,313,243 | 4/1967 | Lauber | 104/101 |
| 3,474,738 | 10/1969 | Di Rosa | 104/130 |
| 3,735,709 | 5/1973 | Matsumoto et al. | 104/130 |
| 3,927,619 | 12/1975 | Bradley | 104/130 |
| 4,662,283 | 5/1987 | Chang | 104/130 |
| 5,052,642 | 10/1991 | Peters | 246/393 |
| 5,494,242 | 2/1996 | Ludwick et al. | 246/393 |
| 5,531,408 | 7/1996 | Wechselberger | 246/257 |

FOREIGN PATENT DOCUMENTS 2510059 of 0000 France .

OTHER PUBLICATIONS

Robotics and Automation Control, Inc. Brochure Undated.
Robotics and Automation Control, Inc. Brochure Jan. 1998.
Robotics and Automation Control, Inc. Brochure Feb. 3, 1997.
Robotics and Automation Control, Inc. Brochure Undated.

*Primary Examiner*—S. Joseph Morano
*Assistant Examiner*—Robert J. McCarry, Jr.
*Attorney, Agent, or Firm*—Zarley, McKee, Thomte, Voorhees & Sease; Dennis L. Thomte

[57] ABSTRACT

A railway switch stand includes a housing with a vertical shaft having a lower end connected to the switch throw rod, the shaft being rotatable to reciprocate the throw rod. A plate is mounted orthogonally on the shaft for rotation with the shaft, and has a plurality of bearings projecting upwardly therefrom around the shaft. A cam follower is mounted to move along a circle with the same radius as the bearings, with a spring mounted above the cam follower to apply a downward biasing force on the cam follower to retain the cam follower between a pair of bearings. A motor has a drive shaft oriented orthogonal to the vertical shaft and includes a drive crank affixed orthogonally to the drive shaft with radially projecting ends. One end of the crank is connected to a U-shaped yoke which in turn is pivotally connected to the cam follower. The other end of the crank has a counterweight, such that the crank will rotate the vertical shaft approximately one-quarter turn upon rotation of the crank approximately one-half turn on the drive shaft.

18 Claims, 10 Drawing Sheets

RAILROAD SWITCH MACHINE

TECHNICAL FIELD

The present invention relates generally to railroad yard switch machines, and more particularly to an improved switch machine which may be electrically operated, provides run-through capability, and has fewer moving parts than existing switch machines.

BACKGROUND OF THE INVENTION

Machines utilizing hydraulic, pneumatic, or electric energy to move railroad switch points to remotely or locally change the route of trains have been used for over 60 years. These devices have been very useful for allowing remote operators to control the movement of trains on main lines and side tracks and also for distribution of railroad cars in railroad switch yards.

Within recent years, use of powered railroad switch movement devices (switch machines) has increased in railroad switch yards as a means of preventing debilitating strains and back injuries to personnel which sometimes result from use of manually-operated switch movement devices (manual switch stands).

One problem with prior art powered switch machines is the large number of parts, and especially moving parts, thereby requiring frequent maintenance and repair. In addition, typical switch machines utilize gears which can be damaged by vibration of the switch points as railroad cars roll through the switch. Prior art powered switch machines also typically require two motor control relays to permit reversing the direction of a motor to operate the switch machine in opposing directions. These two such relays needlessly increase repair frequency and maintenance costs.

A further problem with conventional switch machines, whether powered or manual, resides in the back injuries sustained during manual operation of such switches. The strain placed on the lower back of a railroad employee while attempting to operate the switch is substantial, and leads to frequent injuries and disabilities.

SUMMARY OF THE INVENTION

Principle objects of the present invention are to provide an improved switch machine for use in railroad switch yards and other areas where special locking detection features for high-speed main lines are not required. The invention provides a switch machine with fewer moving parts and simpler design than existing technology, permitting maintenance-free operation and lower cost.

The invention is designed to directly replace most of the popular manual switch stands without need for replacing or moving the switch ties, thereby simplifying installation. The invention is adjusted in a manner similar to the manual switch stands which facilitates installation by track maintenance forces with little instruction.

The invention contains a unique mechanism which allows the switch points to be moved in either direction without having to reverse the direction of the motor thereby only requiring one motor control relay instead of two required by presently existing electric switch machines. The mechanical mechanism for moving the switch points is especially designed to provide a point moving force which follows a general bell curve, to thereby initiate and complete the switching movement at slow speed, with a higher speed movement in the middle of the switching cycle.

The invention also contains a spring-loaded mechanical release which will prevent damage to the motor and crank mechanism if the points of the switch are prevented from moving by a foreign object or if a train moves through the switch when the points are in the wrong direction and forces the points to the other position (trailed through). The mechanical release is designed to cause the vertical shaft to hold the points in position as long as the motor is in its stopped position, regardless of correspondence between the crank mechanism position and the position of the points.

The invention also contains a hand-throw lever device which may be used to disengage the crank mechanism from the vertical shaft to permit manual movement of the switch points if electrical power is lost or the motor or crank mechanism fails. Provision is made to allow the switch points to be locked in position using the hand-throw lever if it is desired to prevent remote movement of the switch points by activation of the motor and crank mechanism.

The hand-throw lever device also includes an ergonomic capability for permitting manual operation of the switch at a much lower force than required in conventional switch mechanisms.

The invention also provides for a railroad switch position indicating device (target) which is similar to existing devices on manual switch stands and is instantly understood by railroad personnel. The target requires no bulbs or electricity to provide switch position indication.

The invention also provides for connection of an external switch point indication rod, thereby eliminating the need for an electromechanical switch point position indication device (switch circuit controller).

Principle features of the invention include a weatherproof housing attached to plates with holes to provide means for mounting the switch machine to the switch ties using spikes, drive screws or bolts. The housing contains a gear motor connected through a crank mechanism and spring-loaded mechanical release mechanism to a vertical shaft. The lower end of the vertical shaft extends through a bearing in the base of the housing where it is connected through a second crank and connecting shaft running between the switch ties to the points of the railroad switch. The upper end of the vertical shaft extends through the top of the housing and is connected to a spring pressure release cam mechanism which is connected to a manual switch throw handle. At the top of the vertical shaft is a target which provides visual indication of the position of the switch.

The railway switch stand of the present invention includes a housing with a vertical shaft having a lower end connected to the switch throw rod, the shaft being rotatable to reciprocate the throw rod. A plate is mounted orthogonally on the shaft for rotation with the shaft, and has a plurality of bearings projecting upwardly therefrom around the shaft. A cam follower is mounted to move along a circle with the same radius as the bearings, with a spring mounted above the cam follower to apply a downward biasing force on the cam follower to retain the cam follower between a pair of bearings. A motor has a drive shaft oriented orthogonal to the vertical shaft and includes a drive crank affixed orthogonally to the drive shaft with radially projecting ends. One end of the crank is connected to a U-shaped yoke which in turn is pivotally connected to the cam follower. The other end of the crank has a counterweight, such that the crank will rotate the vertical shaft approximately one-quarter turn upon rotation of the crank approximately one-half turn on the drive shaft.

Additional objects and features of the invention become apparent to those skilled in the art to which the invention pertains from the following detailed description and claims.

DESCRIPTION OF THE PREFERRED EMBODIMENT

Figure 1:
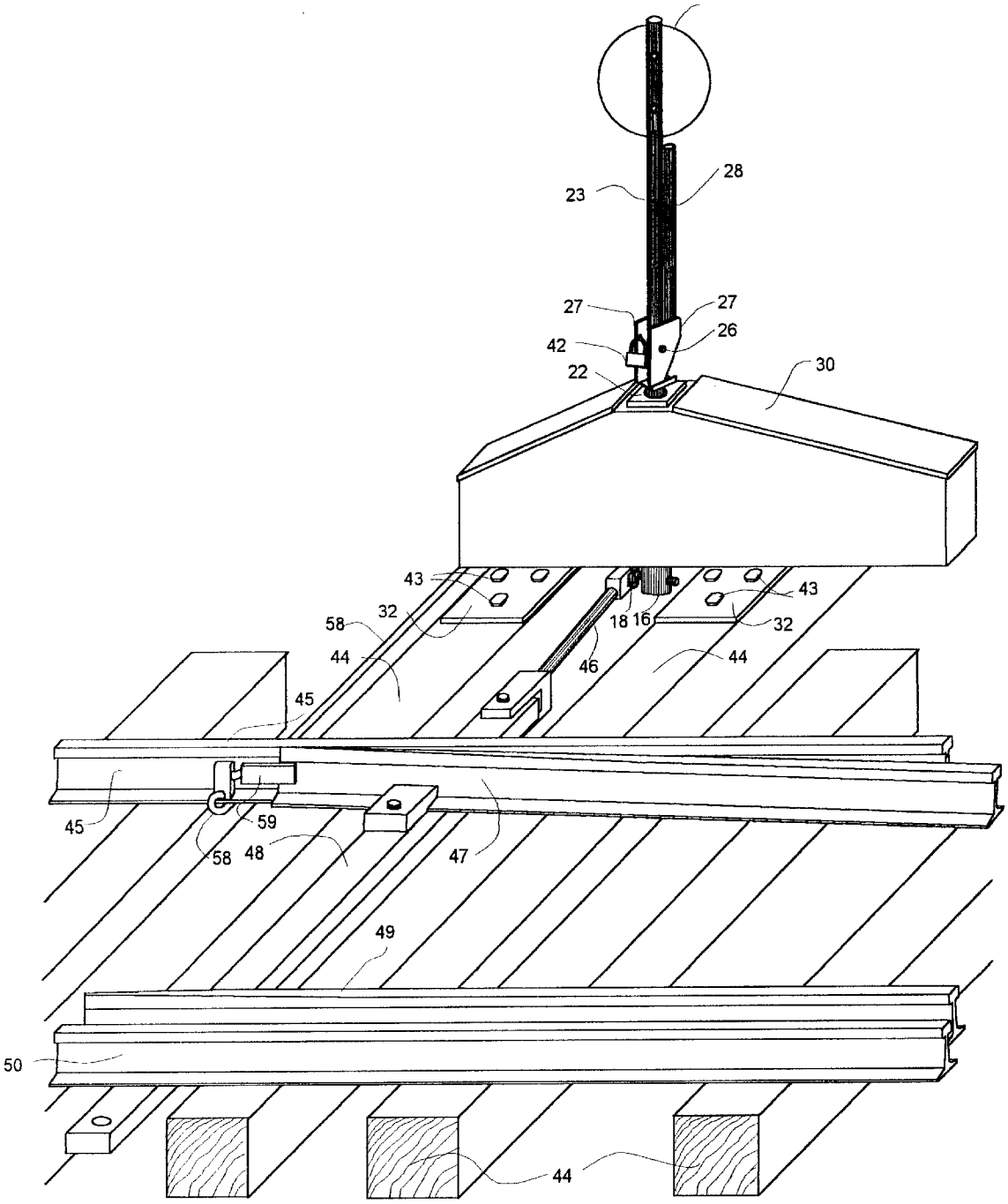
FIG. 1 is a perspective view of the switch machine mounted on ties of a railroad switch and connected to the throw rod of the switch.

Referring now to the drawings, in which similar or corresponding parts are identified with the same reference numeral, FIG. 1 shows the switch machine of the present invention mounted on switch ties 44' using track spikes, drive screws or bolts 43' driven through holes in the tie mounting plates 32'. The switch machine is shown in its normal position with the lower shaft 16 and crank eye 18 turned to the maximum position away from the rails 45 and 50 so as to pull the throw rod 46 and point rod 48 with the connected switch points 47 and 49 tight against the normal running rail 45. The target 41 is mounted on the upper vertical shaft 23 such that it provides visual indication of the position of the railroad switch points 47 and 49. The manual throw handle 28 is shown locked by a padlock 42 in the "power" position.

An optional point detector rod is shown connected to the switch point 47 through a pivoted connector. The other end of the point detector rod is connected to the point detector lever on the switch machine.

Figure 2:
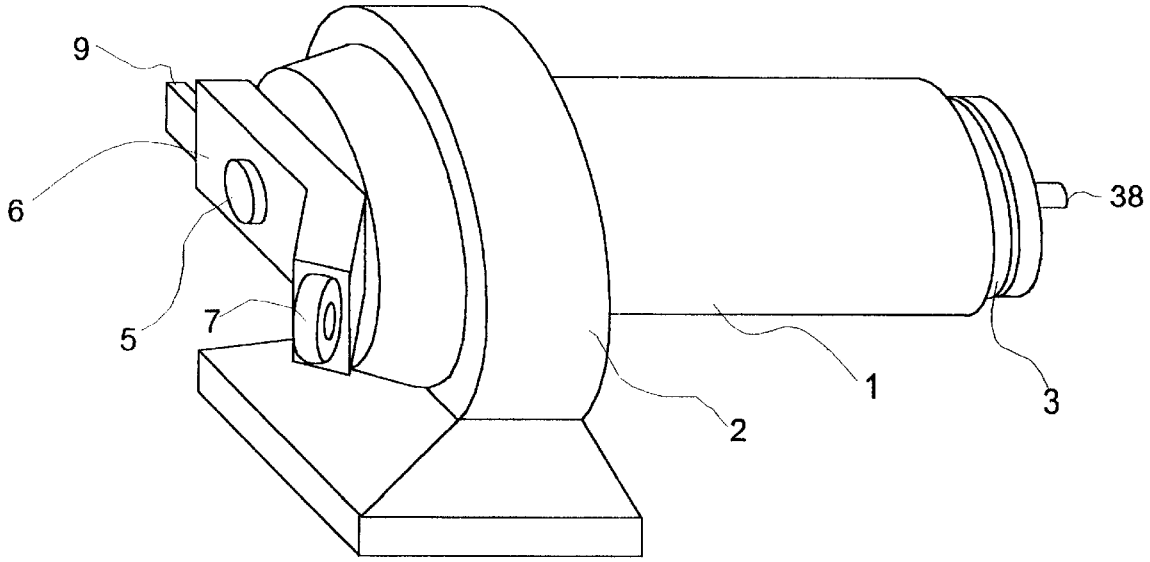
FIG. 2 is a perspective view of the gear motor with motor crank assembly and electromagnetic brake.

Referring now to FIG. 2, an electric brake 3 is mounted on the end of motor shaft 38. The brake 3 is normally applied due to spring action to provide a braking action as the motor 1 slows down and also prevents the motor 1 from inadvertently turning when power is removed. The opposite end of the motor shaft 38 is connected to the gearbox 2. The output shaft 5 is connected to an elongated drive crank 6 having a spherical bearing tie rod end 7 at one end and a proximity switch activation tab 9 at the opposite end. Crank 6 is oriented generally orthogonal to the output shaft 5.

Referring now to FIGS. 4–7, a cylindrical steel pin 8 centered on the base of U-shaped yoke 10 passes through the spherical bearing 7 such that it can rotate and slide longitudinally within said bearing. Both legs of the yoke 10 are connected to a cam follower assembly 12 by two pins 11 such that the yoke 10 can pivot about said pins. Pins 11 are coaxial and oriented perpendicular to the longitudinal axes of shafts 16 and 23.

Figure 3:
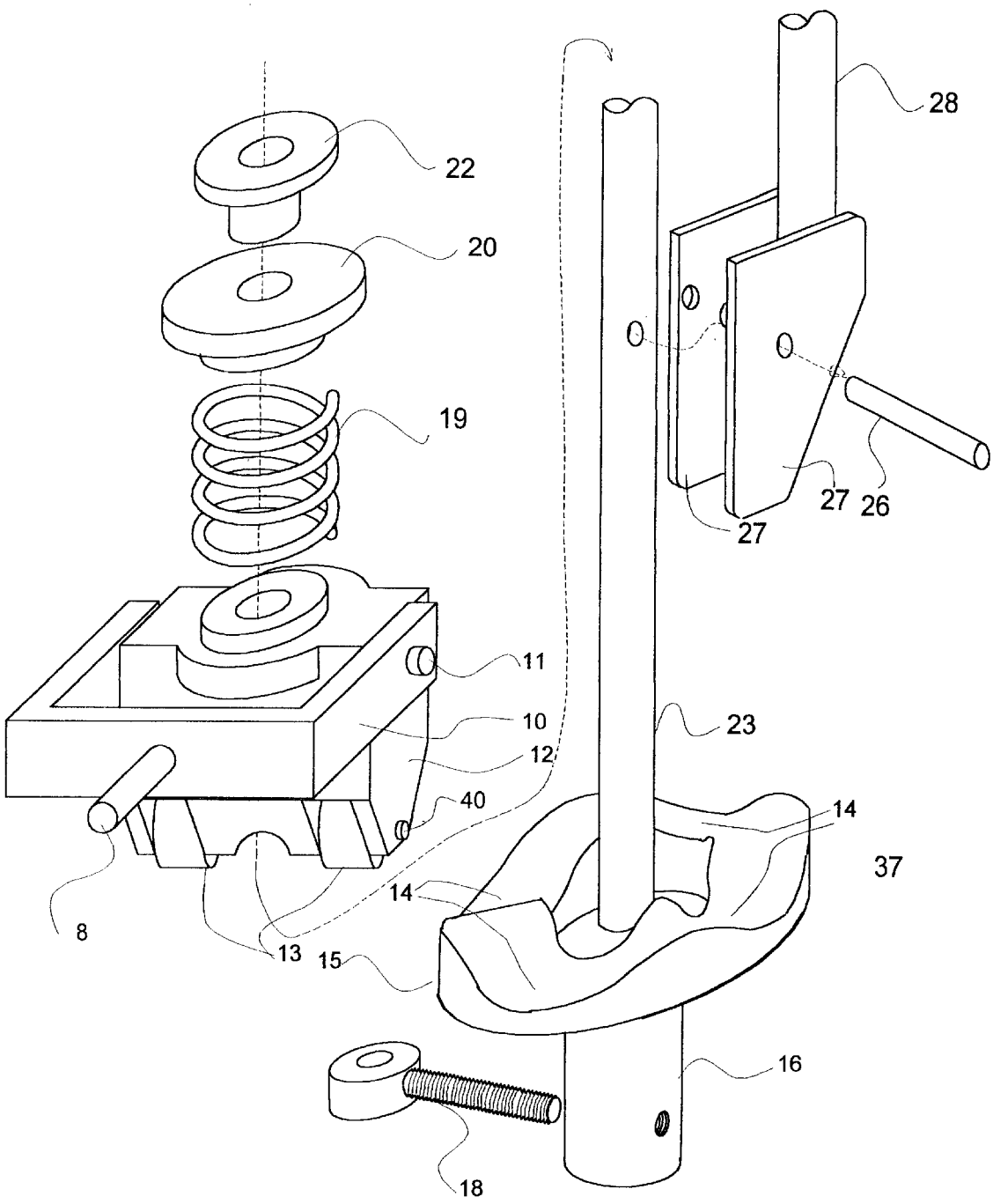
FIG. 3 is a perspective exploded view of the switch mechanism except for the gear motor and motor crank.

Referring now to FIG. 3, the cam follower assembly 12 has a hole running vertically through its center. The vertical shaft 23 passes through the hole such that the cam follower assembly 12 may rotate around and also slide longitudinally on the shaft 23. Attached to the lower end of the shaft 23 is a round plate 15 mounted concentrically and perpendicular to the shaft 23. Four rounded grooves 14 with a radius equal to the cam followers 13 are machined in the upper surface of the round plate 15 such that they are evenly spaced concentrically around the vertical shaft 23. The lower shaft 16 is attached to the lower surface of the round plate 15 such that it is coaxial with the vertical shaft 23, and rotates therewith. The lower shaft 16 passes through lower bearing 17 and the housing base 31 such that it can rotate in the bearing 17. A crank eye 18 is threaded into a hole through lower shaft 16, and perpendicular to the longitudinal axis of shaft 16.

A pair of cam follower wheels 13 are coaxially mounted on pins 40 at the lower end of cam follower assembly 12, with the wheels 13 radially spaced from the shafts 23 and 16 and concentrically aligned with the grooves 14. Wheels 13 have a diameter to fit snugly into rounded grooves 14.

A compression spring 19 is mounted above the cam follower assembly such that it is concentric around the vertical shaft. The upper spring cap 20 is a circular steel plate mounted such that the vertical shaft passes through a hole in its center which allows the upper spring cap 20 to rotate and slide longitudinally on the vertical shaft. The pressure transfer sleeve 22 is mounted concentrically on the vertical shaft 23 directly above the upper spring cap 20 such that it is free to rotate and slide longitudinally on the vertical shaft 23 and also in the upper bearing 24 (shown in FIG. 4) which passes through the upper bearing support plate 25. The two hand throw cams 27 are mounted on the vertical shaft 23 by a single hinge pin 26 which passes through a hole oriented perpendicularly through vertical shaft 23.

Referring once again to FIG. 4, the two hand-throw cams 27 are attached to an elongated handle 28, and pivot along with handle 28 about pin 26 journaled through shaft 23. The hinge pin 26 is positioned such that when the handle 28 is in its vertical "power" position, the long part of cams 27 have cam surfaces **27*a* pushing down on the pressure transfer sleeve 22, which in turn pushes down on upper spring cap 20 and compresses spring 19 against the top of the cam follower assembly 12. This in turn forces the cam follower wheels 13 to center themselves in the grooves 14**.

Figure 8:
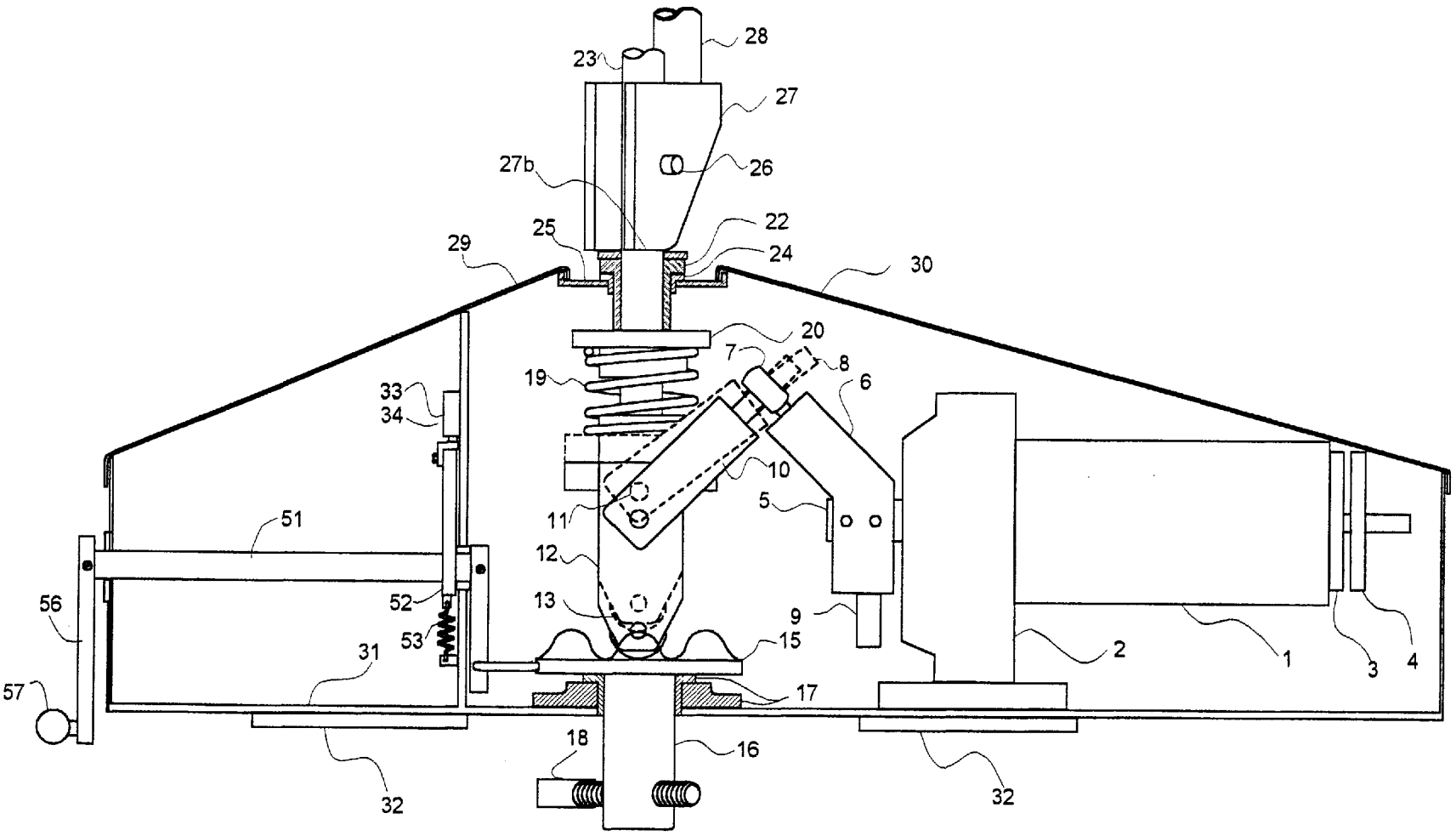
FIG. 8 is a vertical section view of the assembled switch machine shown with the motor crank in its center position and the vertical shaft held in its reverse position.
Figure 9:
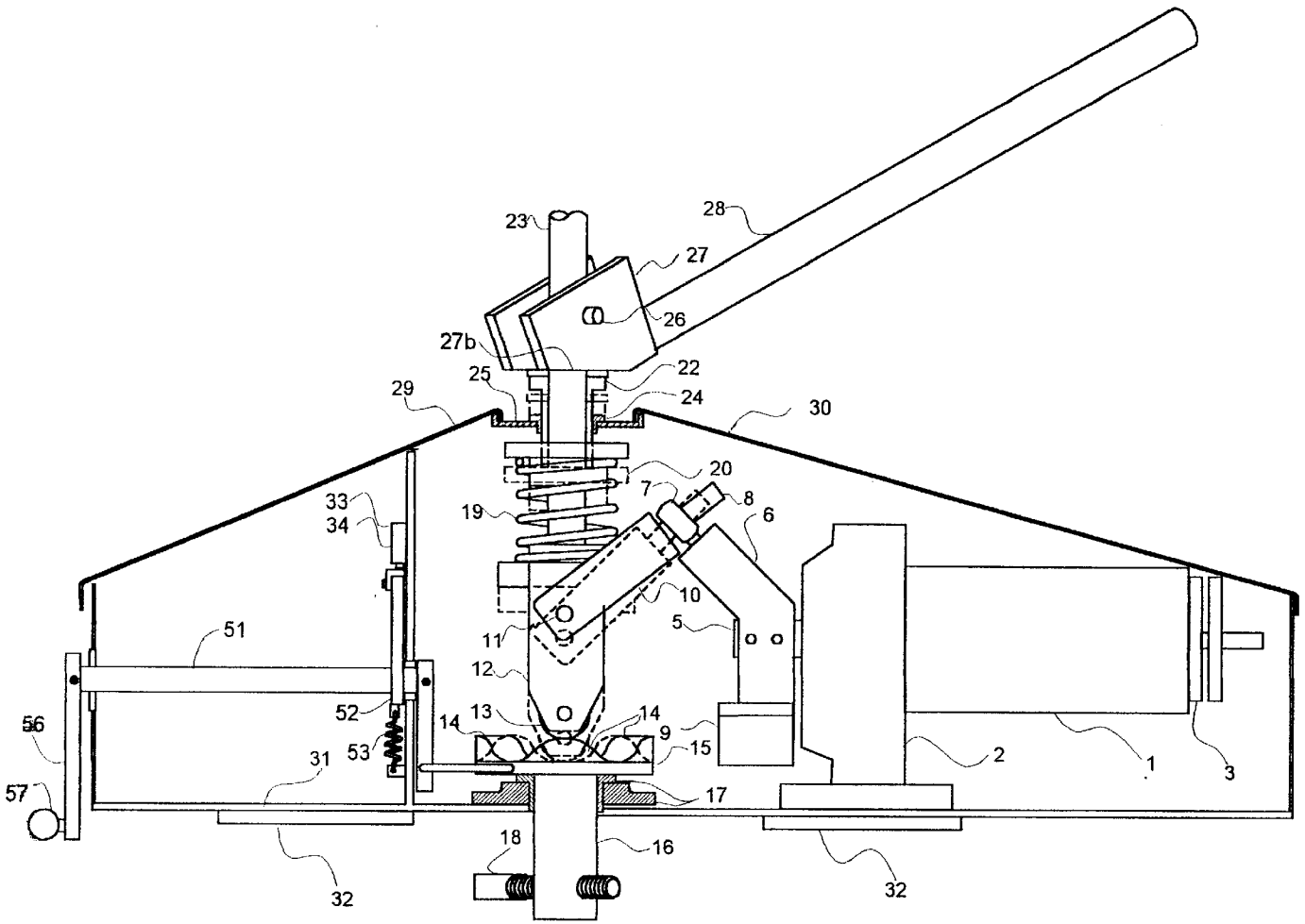
FIG. 9 is a vertical section view of the assembled switch machine shown with the hand throw handle moved down to its hand-throw position.
Figure 10:
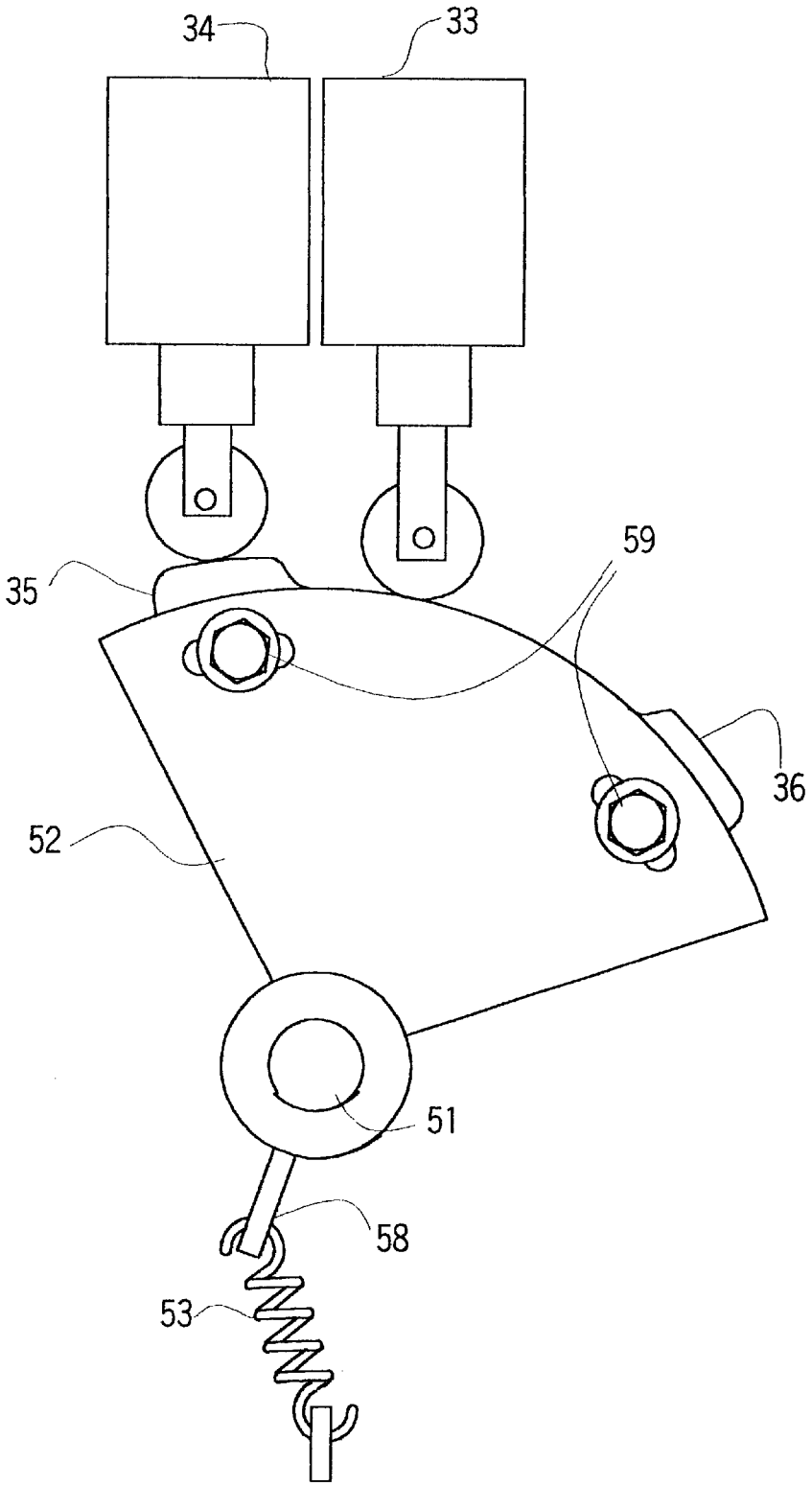
FIG. 10 is a front view of the point detector cam showing adjustable activation tabs and limit switches.

When handle 28 is pivoted to the "manual" position, shown in FIG. 9, the short part of cams 27, with cam surfaces **27*b* are oriented downwardly, to permit pressure transfer sleeve 22 and cam follower assembly 12 to raise upwardly, as shown in FIG. 9, thereby releasing compression of spring 19 and permitting cam follower wheels 13 to raise over the bearings 14, as plate 15 with grooves 14 is rotated along with shaft 23. FIGS. 8 and 9 show the vertical movement of cam follower assembly 12 and the slidable pivotal movement of pin 8 through bearing 7 on drive crank 6, as shaft 23 is rotated by handle 28**.

Figure 4:
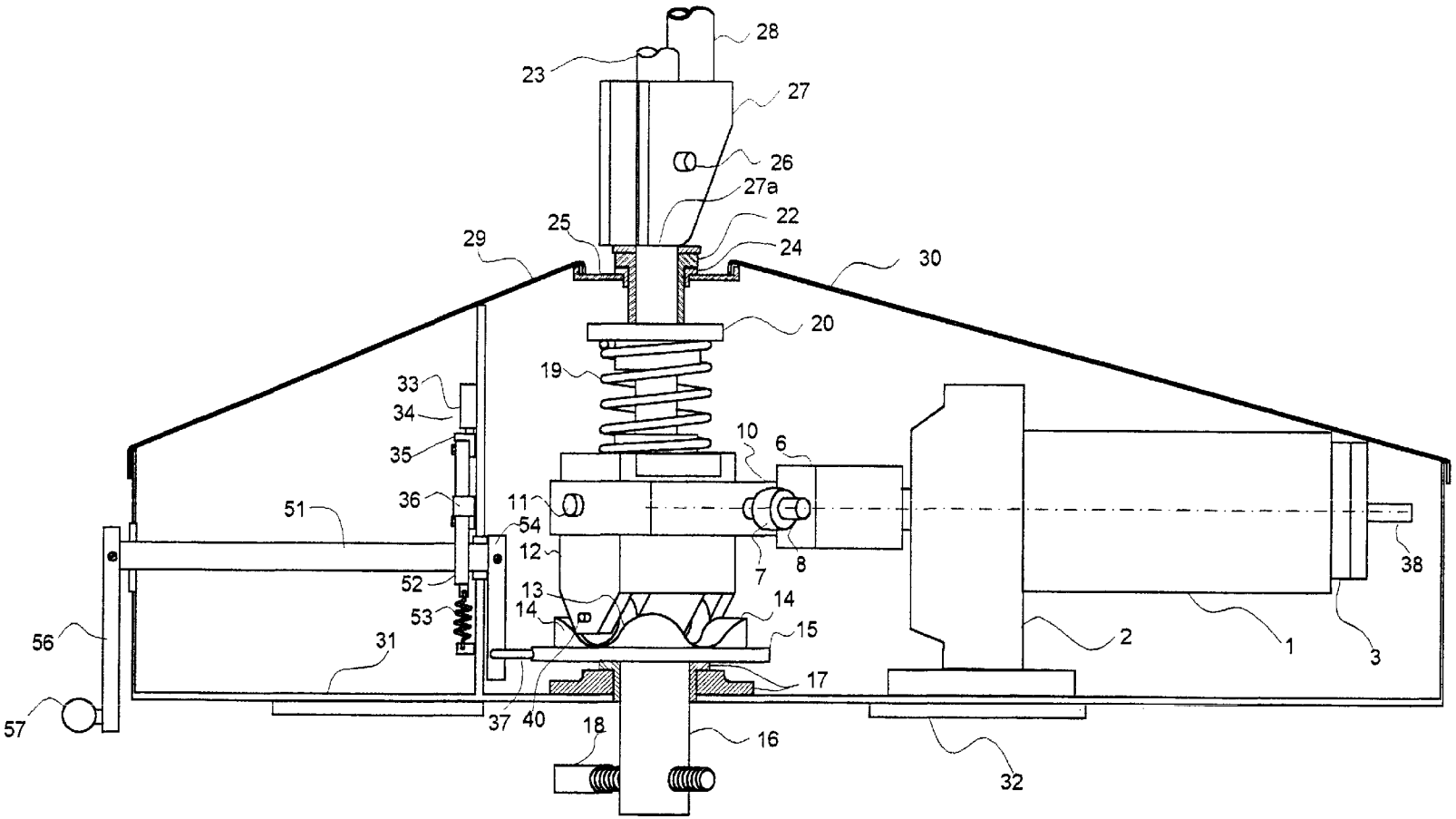
FIG. 4 is a vertical section view of the assembled switch machine shown in one of its two stopped (normal) positions.
Figure 5:
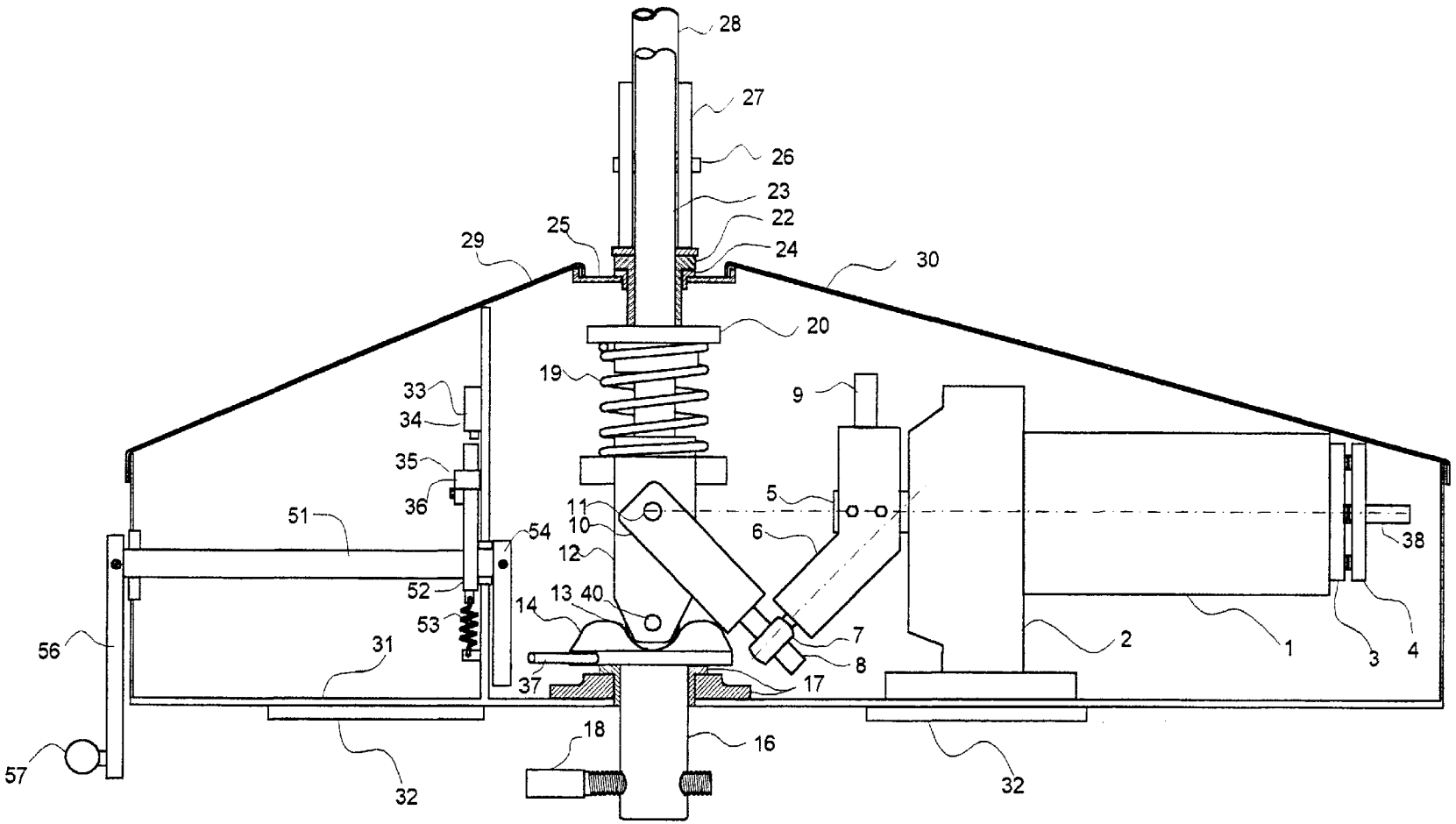
FIG. 5 is a vertical section view of the assembled switch machine shown in its center position after the gear motor has been energized and the motor crank assembly has turned counter-clockwise 90°.
Figure 6:
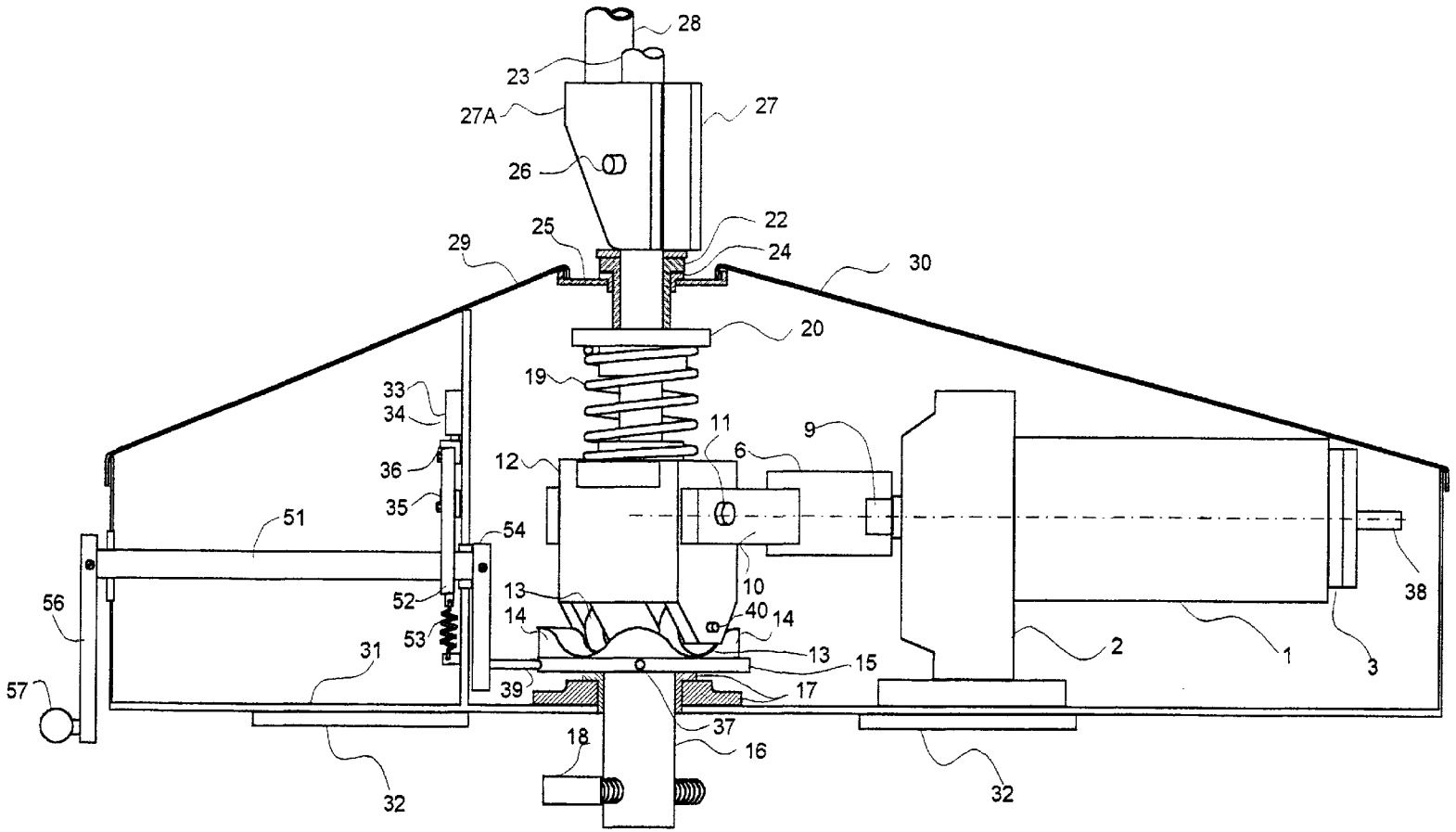
FIG. 6 is a vertical section view of the assembled switch machine shown in its second stopped position (reverse) with the motor crank assembly turned 180° from the normal stopped position.
Figure 7:
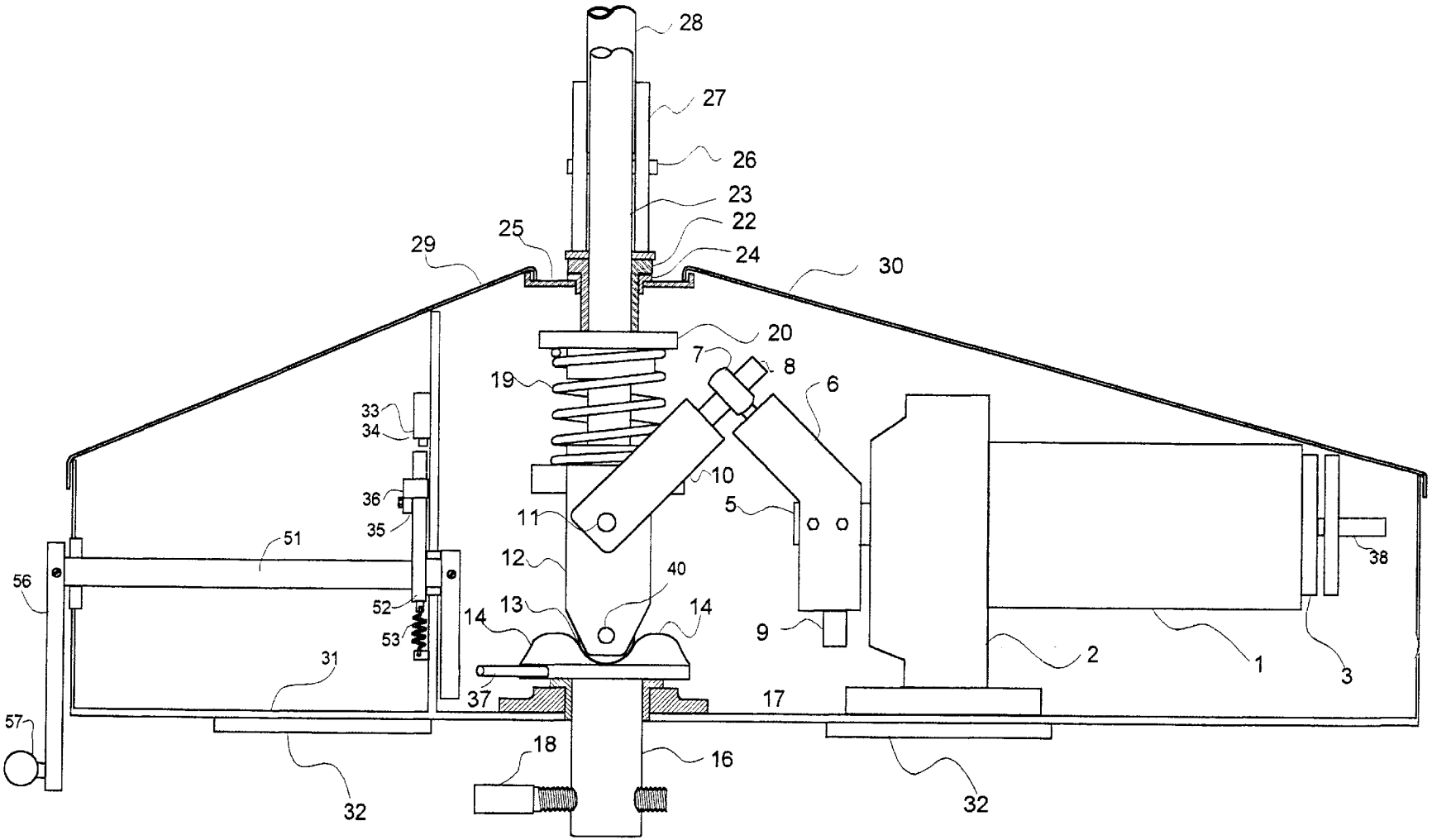
FIG. 7 is a vertical section view of the assembled switch machine shown in its center position as the crank returns from the reverse stopped position to the initial normal stopped position.

As shown in FIG. 4, the normal position of the switch machine is such that yoke 10 is horizontal and the crank eye 18 is at a 45° angle to the longitudinal center of the switch machine. The normal indication activation pin 37 which is attached to plate 15 is pressing against the point position indication lever 54 causing the switch position indication cam 52 to rotate against tension of centering spring 53 until adjustable activation tab 35 is positioned such that the normal position limit switch 34 is activated, providing electrical indication of switch point position. As motor 1 is energized, drive crank 6 will rotate through 180°, as shown in FIGS. 5 and 6. Rotation of drive crank 6 will pivot yoke 10 downwardly to the position shown in FIG. 5, and thence back upwardly to the horizontal position shown in FIG. 6. Thus, shaft 23 and shaft 16 are rotated 90° while drive crank 6 is rotated through 180°. Because compression spring 19 maintains cam follower wheels 13 in grooves 14, wheels 13 will press into grooves 14 and rotate plate 15 along with shafts 23 and 16. The reverse indication activation pin 39 which is attached to plate 15 is pressing against the point position indication lever 54 causing the switch position indication cam 52 to rotate against tension of centering spring 53 until adjustable activation tab 36 is positioned such that the reverse position limit switch 33 is activated, providing electrical indication of switch point position.

It should be noted that the rotational movement of drive crank 6, translated through yoke 10 to rotate lower shaft 16 applies force to throw rod 46, and switch points 47 and 49, along a bell curve. Thus, initial movement of the switch points is slow, movement through the middle of the switching cycle is fast, and the final movement of the switch points to the new position decelerates until contact is made with the associated rail. At the same time, the points are held firmly against the associated rail, upon completion of the switch cycle.

The use of compression spring 19 in association with cam follower assembly 12 and grooves 14 on plate 15, provides run through protection for the switch, and also protects the motor from burn out if debris is caught between the points and the rail (thereby preventing complete movement of the points to the switched position. Compression spring 19 provides a sufficient force to provide holding power of the points against the rail, yet will permit a train to force the points away from the rail, by rotating lower shaft 16, plate 15, and forcing grooves 14 under the cam follower wheels 13, against the bias of spring 19. The normal limit switch 33 or reverse limit switch 34 will still provide proper indication of point position as will target 41.

As noted above, the manual switching is ergonomically designed to substantially reduce the force required to operate the switch when in the manual mode. This reduces back injuries to railroad employees, saving the railroads enormous amounts of money in sick leave and disability claims.

Referring once again to FIG. 1, it can be seen that the switch machine is preferably enclosed within a housing 30, to protect the interior components of the machine from the elements.

Whereas the invention has been shown and described in connection with the preferred embodiment thereof, many modifications, substitutions and additions may be made which are within the intended broad scope of the appended claims.

We claim:

1. A railway switch stand having a reciprocating throw rod extending therefrom for operating the points of a railway track switch, comprising:

a housing with a base plate for supporting the switch stand;

a vertical shaft extending through a hole in the base plate, with a lower end operably connected to the throw rod, said vertical shaft rotatable on its longitudinal axis to reciprocate the throw rod;

a plate mounted orthogonally on the vertical shaft for rotation with the vertical shaft;

a plurality of grooves spaced radially equidistant from the vertical shaft on an upper surface of the orthogonally mounted plate;

a cam follower assembly slidably and rotatably mounted on the vertical shaft above the orthogonally mounted plate;

said cam follower assembly including at least one cam follower mounted at a lower end of the assembly and aligned with the grooves of the orthogonally mounted plate; wherein the radius of the cam follower is equal to the radius of the orthogonally mounted plate;

biasing means connected to the vertical shaft above the cam follower assembly for applying a biasing force downwardly on the cam follower assembly and thereby retaining the cam follower within one of said groves whereby rotating the vertical shaft;

a motor having a drive shaft oriented generally orthogonal to the vertical shaft, selectively operable to rotate the drive shaft, mounted on said housing base proximal the vertical shaft; and operable means interconnecting the drive shaft and the vertical shaft for rotating the vertical shaft from a first position approximately one-quarter turn in a first direction upon rotation of the drive shaft one-half turn in either direction, and for rotating the vertical shaft one-quarter turn in the opposite direction returning to said first position upon continued rotation of the drive shaft another one-half turn.

2. The switch stand of claim 1, wherein the motor is non-reversible.

3. The switch stand of claim 2, wherein said grooves are generally hemispherical in shape.

4. The switch stand of claim 3, wherein said orthogonally mounted plate includes four grooves equally spaced around the vertical shaft.

5. The switch stand of claim 4, wherein said operable means interconnecting the drive shaft and the vertical shaft includes:

an elongated drive crank affixed orthogonally on the drive shaft, with opposing first and second ends projecting radially outwardly from the drive shaft;

a U-shaped yoke with a pair of legs pivotally connected to the cam follower assembly for pivotal movement of the yoke about an axis orthogonal to the vertical shaft axis;

said yoke having a base connecting the legs, and a pin projecting outwardly from the base;

said yoke pin slidably and rotatably connected to the first end of the drive crank.

6. The switch stand of claim 5, further comprising a proximity switch activation tab mounted on the second end of the drive crank.

7. The switch stand of claim 6, wherein said biasing means includes:

an upper spring cap affixed to the vertical shaft, spaced above the cam follower assembly; and a spring mounted between the spring cap and the cam follower assembly.

8. The switch stand of claim 7, further comprising a manual throw handle connected at a first end to the vertical shaft for selectively rotating the vertical shaft.

9. The switch stand of claim 8, further comprising means connected between the handle and the cam follower assembly for selectively releasing the biasing force of the biasing means while manually rotating the vertical shaft.

10. The switch stand of claim 9, wherein said means for releasing the biasing force includes:

a cam pivotally mounted on a pivot pin to the vertical shaft, spaced above the upper spring cap, said cam having a first cam surface and a second cam surface, the first cam surface spaced away from the pivot pin a distance greater than the second cam surface;

said handle first end mounted to the cam, for selectively pivoting the cam between a first position with the first cam surface located directly above the upper spring cap, and a second position with the second cam surface located directly above the upper spring cap, said second cam surface spaced a distance above the spring cap which exceeds the length to which the unbiased spring will extend, to thereby release any spring biasing force on the cam follower assembly.

11. The switch stand of claim 1, wherein said grooves are generally hemispherical in shape.

12. The switch stand of claim 1, wherein said orthogonally plate includes four grooves equally spaced around the vertical shaft.

13. The switch stand of claim 1, wherein said operable means interconnecting the drive shaft and the vertical shaft includes:

an elongated drive crank affixed orthogonally on the drive shaft, with opposing first and second ends projecting radially outwardly from the drive shaft;

a U-shaped yoke with a pair of legs pivotally connected to the cam follower assembly for pivotal movement of the yoke about an axis orthogonal to the vertical shaft axis;

said yoke having a base connecting the legs, and a pin projecting outwardly from the base;

said yoke pin slidably and rotatably connected to the first end of the drive crank.

14. The switch stand of claim 13, further comprising a proximity switch activation tab mounted on the second end of the drive crank.

15. The switch stand of claim 1, wherein said biasing means includes:

an upper spring cap affixed to the vertical shaft, spaced above the cam follower assembly; and a spring mounted between the spring cap and the cam follower assembly.

16. The switch stand of claim 1, further comprising a manual throw handle connected at a first end to the vertical shaft for selectively rotating the vertical shaft.

17. The switch stand of claim 16, further comprising means connected between the handle and the cam follower assembly for selectively releasing the biasing force of the biasing means while manually rotating the vertical shaft.

18. The switch stand of claim 17, wherein said means for releasing the biasing force includes:

a cam pivotally mounted on a pivot pin to the vertical shaft, spaced above the upper spring cap, said cam having a first cam surface and a second cam surface, the first cam surface spaced away from the pivot pin a distance greater than the second cam surface;

said handle first end mounted to the cam, for selectively pivoting the cam between a first position with the first cam surface located directly above the upper spring cap, and a second position with the second cam surface located directly above the upper spring cap, said second cam surface spaced a distance above the spring cap which exceeds the length to which the unbiased spring will extend, to thereby release any spring biasing force on the cam follower assembly.

* * * * *